United States Patent [19]

Phillips

[11] Patent Number: 5,074,348

[45] Date of Patent: Dec. 24, 1991

[54] ADJUSTABLE VALENCE SYSTEM FOR A WINDOW

[76] Inventor: Roderick W. Phillips, 9541 Erickson Drive, Burnaby, Canada

[21] Appl. No.: 622,193

[22] Filed: Dec. 6, 1990

Related U.S. Application Data

[63] Continuation of Ser. No. 411,797, Sep. 25, 1989, abandoned.

[51] Int. Cl.[5] ..... A47H 1/00

[52] U.S. Cl. ..... 160/38; 160/327; 160/368.1; 160/330

[58] Field of Search ..... 160/38, 39, 330, 348, 160/19, 354, 368.1, 327, 328, 126

[56] References Cited

U.S. PATENT DOCUMENTS

| | | | |
|---|---|---|---|
| 2,430,959 | 11/1947 | Soff | 160/38 |
| 2,547,697 | 4/1951 | Gallo | 160/330 |
| 3,181,594 | 5/1965 | Shapiro | 160/124 |
| 3,196,511 | 7/1965 | Kintner | 160/330 |
| 3,321,004 | 5/1967 | Lopes | 160/38 X |
| 3,399,711 | 9/1968 | Stulac et al. | 160/330 |
| 3,545,085 | 12/1970 | Stewart | 33/12 |
| 3,733,227 | 5/1973 | Collins | 156/196 |
| 3,777,800 | 12/1973 | Susoev | 160/84.1 |
| 3,996,987 | 12/1976 | Rodriguez | 160/19 |

*Primary Examiner*—David M. Purol

*Attorney, Agent, or Firm*—Fetherstonhaugh & Co.

[57] ABSTRACT

An ornamental valence treatment for windows enables swags or festoons to be arranged in a variety of different arrangements to suit different window dimensions. The treatment uses standard components and enables them to be easily removed for washing or cleaning. At least two decorative swags are provided for draping from a support member, each swag has at least one attachment edge with a hook tape along one side of the edge and a loop-tape along the other side of the edge and a loop-tape along the other side of the edge, such that the two swags can be joined together by the hook-tape of one swag engaging with the loop-tape of the other swag.

6 Claims, 2 Drawing Sheets

ADJUSTABLE VALENCE SYSTEM FOR A WINDOW

This application is a continuation of application Ser. No. 07/411,797, filed 9/25/89, now abandoned.

BACKGROUND OF THE INVENTION

The present invention relates to an ornamental valance treatment of a window. More specifically the present invention relates to the installation of swags or festoons in a valance arrangement that is adjustable to suit any number of window sizes.

Window display treatment in residences and commercial buildings involves a valance system generally positioned outside the curtains over a window. In many cases the valance, sometimes referred to as drapery, involves a number of swags or festoons that drape down from a top support such as a valance support or a curtain rod and often have jabot elements at each end to provide a decorative treatment of a window. The swags or festoons may overlap one over the other and in some cases there is a centre swag overlapping the swags on adjacent sides. In other cases the swags overlap in line either from left to right or right to left. The jabot elements may overlap the swags or extend from under the swags.

In existing valance treatment, it is generally necessary to measure the dimension of windows, including both width and height, cut the swags or festoons to suit the particular width of window and then join them together by sewing. The valance treatment is attached to a support such as a curtain rod or a valance support generally tacked or stapled in place so that it becomes permanent. Once the assembly has been made it is difficult to change, and furthermore it is also difficult to remove for cleaning purposes without removing staples, nails and the like. Various attempts have been made to make removable units but all of them are made to suit a fixed dimension of window. Some swags have standard dimension and are made for standard window dimensions. They may be removed for cleaning and replaced in exactly the same configuration.

AIMS OF THE INVENTION

It is an aim of the present invention to provide a valance treatment for a window which is made of standard components both swags and jabot elements that can easily be mounted to suit almost any width of window. The swags can overlap each other and can be placed overlapping from left to right or alternatively from right to left. Furthermore, it is another aim to provide a valance system that can easily be removed for washing and cleaning purposes and then replaced in a different configuration, that is to say overlapping left to right, right to left or other arrangements.

It is further aim of the present invention to prepare a set of standard swags or festoons and a set of standard jabot elements which can be arranged in the field by an installer or by a householder, thus the valance treatment need not be performed by a professional.

SUMMARY OF THE INVENTION

The present invention incorporates swags or festoons, either in the form of a substantially semi-circular shape or some other shape with a straight attachment edge along the top and having a hook-tape along one side of the edge and a loop-tape along the other side of the edge, these tapes being of the type that engage and hold together when a hook-tape is pressed against a loop-tape. The hook-tape and loop-tape arrangement on both sides of an attachment edge permits swags to be mounted on either a mounting strip or on top or underneath the other. Several layers of swags may be positioned and rearranged as desired by utilizing the hook-tape and loop-tape connection system.

The present invention provides in a valance treatment for a window, including a support member positioned above the window, the improvement comprising at least two decorative swags for draping from the support member, each swag having at least one attachment edge with a hook-tape along one side of the edge and a loop-tape along the other side of the edge, such that the two swags can be joined together by the hook-tape of one swag engaging with the loop-tape of the other swag.

BRIEF DESCRIPTION OF THE DRAWINGS

In drawings which illustrate the embodiments of the invention.

DESCRIPTION OF A PREFERRED EMBODIMENT

Figure 1:
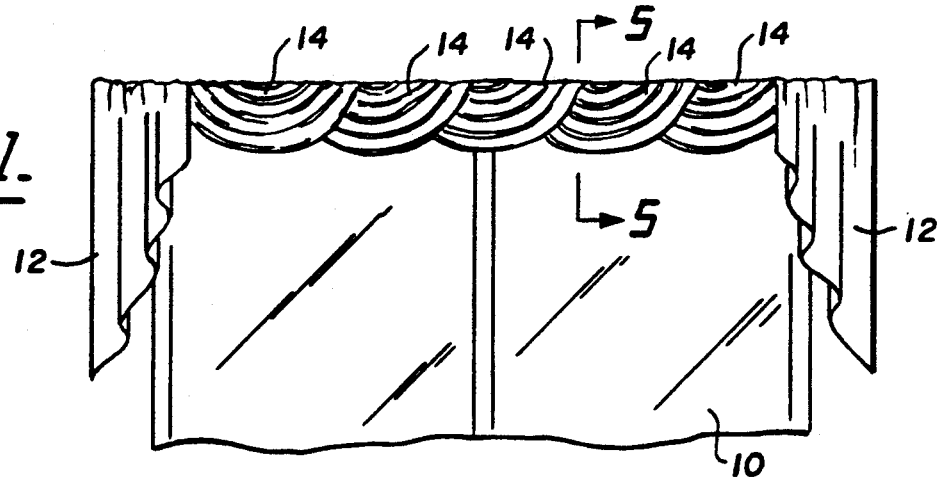
FIG. 1 is an elevational view showing one embodiment of a valance treatment for a window.

FIG. 1 illustrates a valance treatment for a window 10 which has jabot elements 12 at each side of the window 10 and a series of swags 14 which overlap on the right hand side from left to right.

Figure 2:
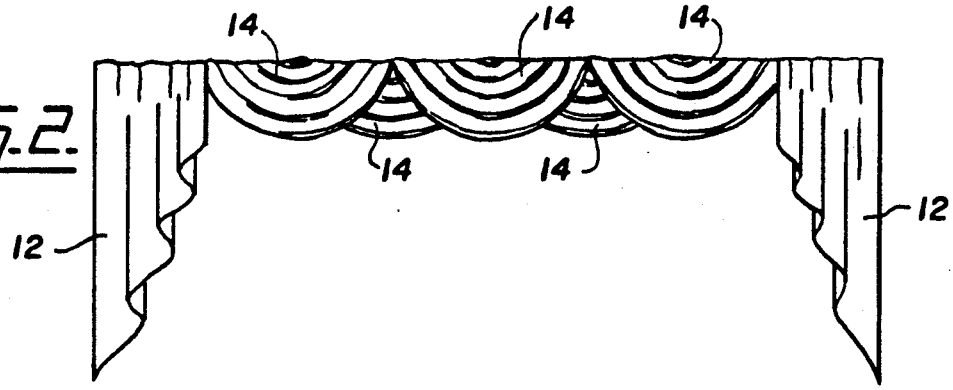
FIG. 2 is an elevational view showing another embodiment of a valance treatment for a window.

FIG. 2 shows another arrangement wherein the swags 14 are arranged with three in a row, edge to edge, which do not overlap and underneath two swags having centres midway between the join between the top swags and being overlapped by the top swags.

Figure 3:
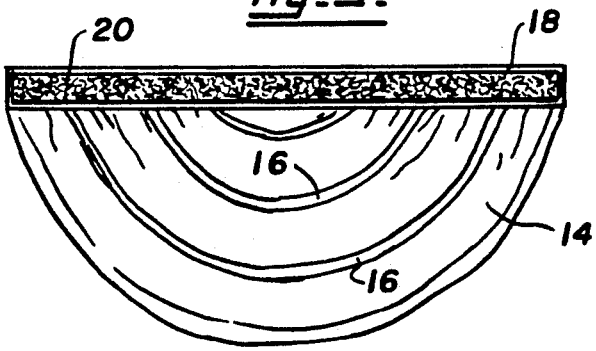
FIG. 3 is a front view of one type of swag according to the present invention with a hook-tape along one side of an attachment edge and a loop-tape on the other side.
Figure 4:
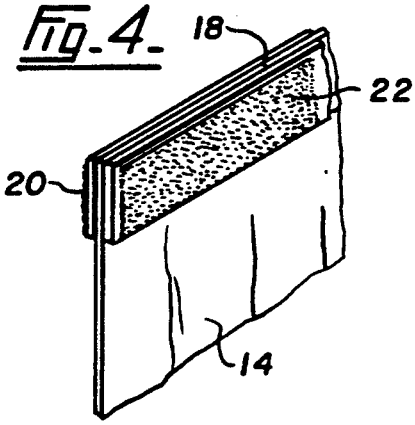
FIG. 4 is a partial isometric view showing the hook-tape on one side and the loop-tape on the other side of a swag similar to that shown in FIG. 3.

One example of a swag is shown in FIG. 3 and FIG. 4. The swag is made of textile material and has a substantially semi-circular shape with a series of loops or folds 16 which are decorative and provide a decorative effect. An attachment strip 18 extends across the top of the swag 14 with the folds are sewn to the attachment strip 18. In the embodiment shown the swag is semi-circular and has the attachment strip 18 extending substantially along what might be referred to as the diameter. However the shape of the swag may be half oval or other curved arrangement. Whereas semi-circular is the term used for defining the shape of the swag, it will be apparent that the shape of the swag is not limited neither is it intended to limit the shape of the swag even when it is referred to as semi-circular in the test of the present specification.

The attachment strip 18 has on one side a loop-tape 20 and on the other side a hook-tape 22. Whereas FIG. 4 indicates the tape sections as being thick, this is for illustration purposes only and in practice the loop-tape 20 and hook-tape 22 need not be thick but are similar to those types often used in clothing and other attachment systems.

Figure 5:
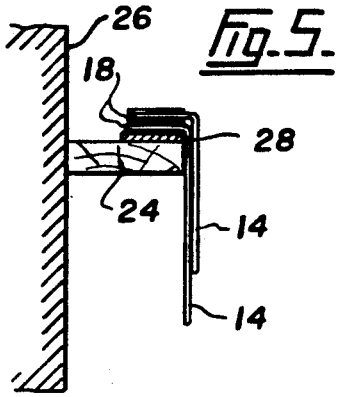
FIG. 5 is a cross-section taken at line 5—5 of FIG. 1.

FIG. 5 illustrates a cross-section through the valance treatment shown in FIG. 1. A wood strip 24 or valance support is shown extending from a wall 26 and is attached to the wall in a permanent manner, namely by screws or the like. On top of the wood strip 24 is attached either a hook-strip or a loop-strip 28 for engagement with an attachment edge of a swag. As shown in FIG. 5 the appropriate attachment strip 20 or 22 on one side of the underneath swag 14 is pressed onto the attachment strip 28 on the wood strip 24 and the attachment strip 20 or 22 of the top swag 14 is then pressed directly down onto the attachment strip 20 or 22 of the bottom swag 14. The swags bend through an angle of 90° as can be seen in FIG. 5, so that the strip 18 is not visible from below. All that is visible from below is the fold in the swag. Reference is made to FIGS. 1 and 2 for viewing this arrangement.

For installation of the swags it is necessary to ensure that the wood strip 24 with the attachment tape 28 is placed above the window and then the required number of swags are arranged in any configuration that is desired. The jabot elements 12 also have loop-tapes on one attachment edge and hook-tapes on the other edge so they may be placed either on top of the adjacent swags 14 or alternatively underneath. By having both sides of an attachment edge 18 with loop-tape or hook-tape thereon enables any arrangement or variation of the valance treatment to be made. Furthermore if it is needed to clean the valance treatment then each individual element may be removed by simply separating the loop-tape from the hook-tape and either washing or cleaning that element before reassembling. Furthermore if one wishes to either extend the length or reduce the length of the valance treatment then it is merely necessary to change the overlap of the swags and the jabot elements in any manner that is desired. Thus complete flexibility to assemble the valance treatment lengthwise and different overlaps or underlaps may be achieved.

Figure 6:
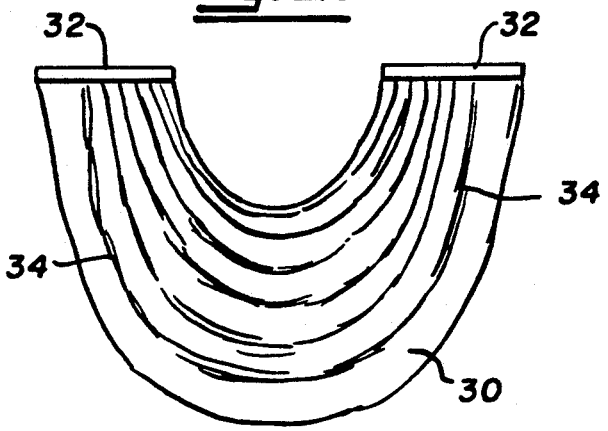
FIG. 6 is another swag or festoon piece with attachment edges at both ends.
Figure 7:
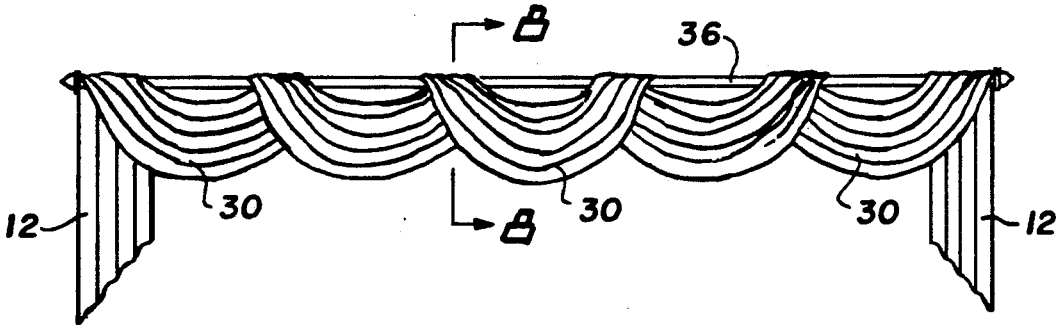
FIG. 7 is a front elevation showing a valance treatment for a window utilizing the swags as shown in FIG. 6 drooped over a curtain rod.
Figure 8:
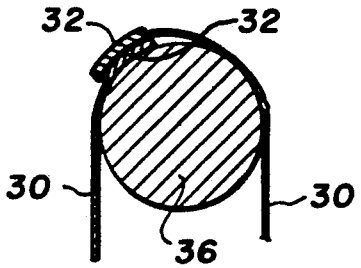
FIG. 8 is a cross-sectional view taken at line 8—8 of FIG. 7.

FIG. 6 shows another arrangement of a swag 30 as a continuous drape with attachment strips 32 at both ends. The attachment strips 32 have loop-tapes on one side and hook-tapes on the other similar to the manner shown for the swags 14 in FIGS. 3 and 4. Folds 34 are shown within each swag 30 to act as folds and to provide an attractive visual effect. FIG. 7 illustrates an arrangement of continuously joined together swags 30 arranged around a curtain rod or drapery pole 36. FIG. 8 illustrates that the join between swags 30 occurs substantially at the back of the rod 36 so it is not visible from the side or underneath. In another embodiment a loop-strip or hook-strip may be attached to the rod 36 for engaging the loop or hook-tape on the rod 36. This strip may extend for the length of the rod 36 thus providing flexibility for location of the swags along the rod 36. This ensures the position of each attachment strip 32 of the swags is maintained at the location on the rod 36 where the strip is located.

By disconnecting the attachment strips 32 from each other, the swags may be rearranged so that they overlap from one side to the other or in different arrangements as illustrated in FIGS. 1 or 2 provided they overhang the rod 36, and if preferred the attachment strips 32 come at the back of the rod, similar to that shown in FIG. 8, so they are not visible.

As shown in FIG. 7 jabot elements 12 are provided at each end, these have attachment strips similar to that illustrated in FIGS. 1 and 2 so that they join to the attachment strips 32 on the ends of the swags 30. The jabot elements 12 may pass over the front or the back of the rod 36 dependent upon the choice of the installer.

As shown in FIGS. 1 and 2 the swag arrangements may be removed by simply separating the attachment strips 32, washing or cleaning the swags 30 and jabot elements 12 and then rearranging them either in the form they were originally installed or in a different form.

Various changes may be made to the embodiments shown herein without departing from the scope of the present invention which is limited only by following claims:

The embodiments of the present invention in which an exclusive property or privilege is claimed are defined as follows:

1. A valence treatment for a window having: a support member positioned above the window having a planar surface on which fastening tape of the hook or loop type is mounted; decorative swags for draping from the support member, each swag having a shape defined by a straight edge and a curved edge joining the ends of the straight edge, a first fastening tape having loops fastened to one side of the swag adjacent and parallel to the straight edge, and a second fastening tape having hooks fastened to the other side of the swag adjacent and parallel to the straight edge to form a two-tape arrangement on each swag permitting the swag to be selectively, detachably connected: directly to the support member; indirectly to the support member via one or more other swags which other swags are at least partly directly connected to the support member; or partly directly to the support member and partly indirectly to the support member by way of one or more other swags which other swags are at least partly directly connected to the support member.

2. A valence treatment as claimed in claim 1 wherein the planar surface on the support member is a horizontal surface.

3. A valence treatment for a window having: a rod-like support member positioned above the window; decorative swags for draping from the support member, each swag having a shape in the form of a strip with straight edges a both ends, first fastening tapes having loops fastened to one side of the swag adjacent and parallel to the two straight edges, second fastening tapes having hooks fastened to the other side of the swag adjacent and parallel to the two straight edges, the tape arrangement on each swag permitting the swags to be detachably fastened end to end with the fastened swags draped over the curtain rod.

4. A valence treatment as claimed in claim 3 including a fastening tape having hooks or loops fastened along the length of the rod, the tape arrangement on each swag and the rod permitting the swags to be detachably fastened end to end with the fastened swags draped over and detachably fastened to the curtain rod.

5. A valence treatment for a window having: a rod-like support member positioned above the window; decorative swags for draping from the support member, each swag having a shape in the form of a strip with straight edges at both ends, first fastening tapes having loops fastened to one side of the swag adjacent and parallel to one of the straight edges and to the other side of the swag adjacent and parallel to one of the straight edges, second fastening tapes having hooks fastened to the other side of the swag adjacent and parallel to the other of the straight edges and to the one side of the swag adjacent and parallel to the other of the straight edges, to form a tape on each swag permitting the swags to be detachably fastened end to end with the fastened swags draped over the curtain rod.

6. A valence treatment as claimed in claim 5 including a fastening tape having hooks or loops fastened along the length of the rod, the tape arrangement on each swag and the rod permitting the swags to be detachably fastened end to end with the fastened swags draped over and detachably fastened to the curtain rod.

* * * * *